US007141010B2

(12) United States Patent
Levine

(10) Patent No.: US 7,141,010 B2
(45) Date of Patent: Nov. 28, 2006

(54) VARIABLE RADIUS FLEXIBILITY APPARATUS

(76) Inventor: James H. Levine, 60 Lake Shore Dr. North, Westford, MA (US) 01886

( * ) Notice: Subject to any disclaimer, the term of this patent is extended or adjusted under 35 U.S.C. 154(b) by 24 days.

(21) Appl. No.: 10/092,907

(22) Filed: Mar. 6, 2002

(65) Prior Publication Data

US 2003/0171197 A1 Sep. 11, 2003

(51) Int. Cl.
*A63B 26/00* (2006.01)

(52) U.S. Cl. ..... 482/142; 482/907

(58) Field of Classification Search ..... 601/86–87, 601/90, 98; 482/142, 148, 907; 606/241–242, 606/245, 237

See application file for complete search history.

(56) References Cited

U.S. PATENT DOCUMENTS

| | | | | |
|---|---|---|---|---|
| 2,010,766 | A | 8/1935 | Longfellow | 5/327 |
| 2,433,548 | A * | 12/1947 | Ecks | 601/90 |
| 2,475,003 | A * | 7/1949 | Black | 606/243 |
| 2,598,204 | A | 5/1952 | Allen | 128/74 |
| 4,451,034 | A * | 5/1984 | Gin | 482/148 |
| 4,606,332 | A * | 8/1986 | Gibson | 606/242 |
| 4,795,150 | A | 1/1989 | Harlan | 272/144 |
| 4,927,139 | A | 5/1990 | Taltre | 272/144 |
| 5,100,131 | A | 3/1992 | Fong | 482/112 |
| 5,385,531 | A * | 1/1995 | Jover | 601/99 |
| 5,531,658 | A | 7/1996 | Liao | 482/142 |
| 5,601,519 | A * | 2/1997 | Comereski | 482/142 |
| 5,833,590 | A | 11/1998 | Chiu et al. | 482/142 |
| 5,913,758 | A | 6/1999 | Nunez | 482/142 |
| 6,569,069 | B1 * | 5/2003 | Linares | 482/148 |
| 6,616,227 | B1 * | 9/2003 | Blendea et al. | 297/284.4 |
| 6,631,951 | B1 * | 10/2003 | Blendea et al. | 297/284.4 |
| 6,676,214 | B1 * | 1/2004 | McMillen et al. | 297/284.1 |
| 6,692,074 | B1 * | 2/2004 | Kopetzky et al. | 297/284.8 |

* cited by examiner

*Primary Examiner*—Gregory L. Huson
*Assistant Examiner*—Fenn C. Mathew

(57) ABSTRACT

A muscle stretching and spine decompressing apparatus including a base frame (20), a flexible sheet (12) attached to the top of the base frame (20) for supporting the body of a user, and a motorized actuation means (16) for bending the flexible sheet (12) from a substantially flat position to a substantial arc. The motor (18) includes a main shaft (30) connected at each end (30*e*) to counter grooved helix pulleys (46). As the motor (18) turns the main shaft (30), the counter grooved helix pulleys (46) wind up cable (48) attached to the ends (12*a*, 12*b*) of the flexible sheet (12), thereby drawing the flexible sheet ends (12*a*, 12*b*) inward to cause the flexible sheet (12) to bend. The motor control system (92) provides for automatic or manual control of the arc of flexible sheet (12).

2 Claims, 11 Drawing Sheets

VARIABLE RADIUS FLEXIBILITY APPARATUS

FIELD AND BACKGROUND OF THE INVENTION

This invention relates generally to fitness exercise equipment, more particularly to muscle stretching and spine decompression exercise equipment.

The trends in fitness exercise devices over the past 40 years began with strengthening exercise (resistance training) equipment, then aerobic exercise equipment, and now has evolved to flexibility exercise equipment. This third category of fitness exercise devices has recently emerged to address the need for enhancing muscle stretching and spine decompression. Chronic muscle contraction and spine compression can occur from injury, fatigue, excessive sitting and standing, over or under exercising, and gravity. Even the two prevalent forms of exercise, aerobics and resistance training, tone the muscles through repetitious contraction. Although healthy, this creates an added need for flexibility in order to bring the muscles into a relaxed balance between contraction and extension.

Static and dynamic muscle stretching and spine decompression devices are known in the prior art. Longfellow in U.S. Pat. No. 2,010,766 asserts a device that begins in a relatively flat position and is bent into an arc that is very limited due to the fixed sheet ends being unable to be drawn towards each other.

Ecks in U.S. Pat. No. 2,433,538 also describes a device that begins in a relatively flat position and is bent into an arc that is very limited in range.

Fong in U.S. Pat. No. 5,100,131 asserts a device that requires the user to begin the exercise in a seated position and rotate into a limited arc defined by two constant arcs with only one arc pivoting at a fixed point. These devices limit the user to conforming to the limited arc, which can be too much or too little for the great variety of body types, resulting in either hyperextension or insufficient stretching and/or decompression benefit.

Harlan in U.S. Pat. No. 4,795,150 asserts a means for stretching the leg muscles of a user straddling two hinged sheets. This device requires the user to begin stretching in a raised high degree of arc and then increases the stretch as it flattens the arc.

L. S. C in U.S. Pat. No. 5,531,658 asserts a means for strengthening the mid-section of a user by requiring the user to actively push two pull rods with the user's hands and feet to arc the body until a significant portion of a user's body is in uncomfortably, unsupported positon. The effort to self-support the body weight overhanging the sheet may assist strengthening, but would hinder the relaxation required for flexibility. The user starts in a lying down positon on a sheet that has a significant degree of arc. Due to the relatively short length of that surface, the sheet forms an acute and uncomfortable degree of arc as the mid section of the body is lifted.

None of the above inventions and patents describe a device that allows the support platform to adjust from a substantially flat position to a semi-circular arc with a relatively small radius of approximately 27 Inches.

Current stretching exercise devices tend to be uncomforable and unsafe because tbey do not provide the comfort of full-body support combined with the safety of adjusting to users' needs.

It is an object of this invention to provide a muscle stretching and spine decompression device for exercise and rehabilitation of the soft tissue and joints of the body, while minimizing discomfort and risk of injury.

It is a further object of this invention to facilitate flexibility by providing relaxation and muscle stretching while having a user exert no effort.

SUMMARY OF THE INVENTION

The present invention is a muscle stretching and spine decompression apparatus that allows for bending and straightening the user's body from a substantially flat position to a semi-circular arc that creates an elogating force to stretch a user's spinal column and muscles at a comfortable speed and with the ability to stop at any point in between. The one embodiment of the present invention provides a flexible sheet of polycarbonate, approximately 72"×24"×¼", that acts as a support surface platform for the user. Any suitable sheet material, such as plastic or metal, can be used in place of polycarbonate providing its bending characteristics are substantially the same. The sheet is flexible enough to bend to desired comfortable arcs and strong enough to support any human weight. Cables and pulleys are attached to the ends of sheet to draw sheet inward along the support frame by a motor, thereby increasing the arc of the sheet. Whereby, the user's muscles are relaxed during the operation of the present invention. As the sheet ends are drawn in, rigid struts pivotally attached to the sheet provide added support to the sheet at key load bearing points. The motor can be controlled either manually, or by varied pre-defined programs consisting of adjustable cycles, time, repetitions and stops.

The present invention stretches the muscles of the torso and decompresses the spine of a user by arching the user on a one piece sheet by electro-mechanical means. The user begins stretching in a lowered flat degree of arc (approximately 147 inches radius) and then increases the stretch as the arc is increase (up to approximately 27 inches radius). The user's entire body is comfortably supported during the extension (arc increase) and retraction (arc decrease) operations. The effortless raising and lowering of a user's mid-section would facilitate the muscle release compatible with efficient muscle stretching. The relatively long length of the sheet facilitates a gradual and comfortable degree of arc.

Other objects, features, and advantages will be apparent from the following detailed description of preferred embodiments taken in conjunction with the accompanying drawings in which:

DETAILED DESCRIPTION OF THE PRESENT INVENTION

Figure 1:
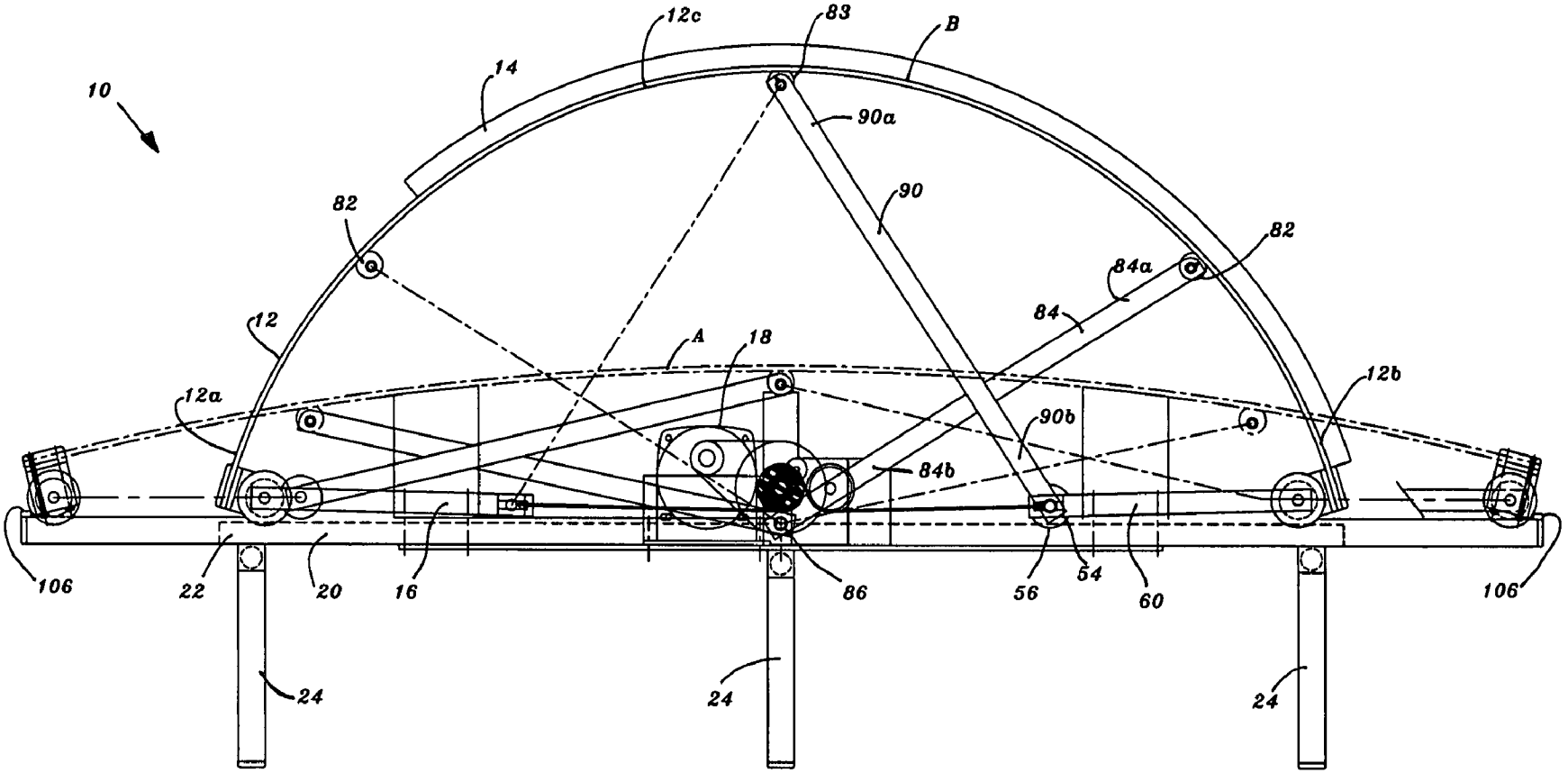
FIG. 1 is a side view of the present invention with phantom lines illustrating the sheet retracted and solid lines illustrating the sheet extended.

Generally, as shown in FIG. 1 of the drawings, the present invention 10 relates to a variable radius flexibility apparatus including a sheet 12 made of polycarbonate, such as Lexan®, or other high strength, flexible, resilient material and a vinyl-covered cushioning material 14. The sheet 12 is pivotally joined at its ends 12*a* to an actuation system 16, which is driven by a motor 18. The above-mentioned components are movably, pivotally, or fixedly attached by conventional means to a frame 20.

Figure 2:
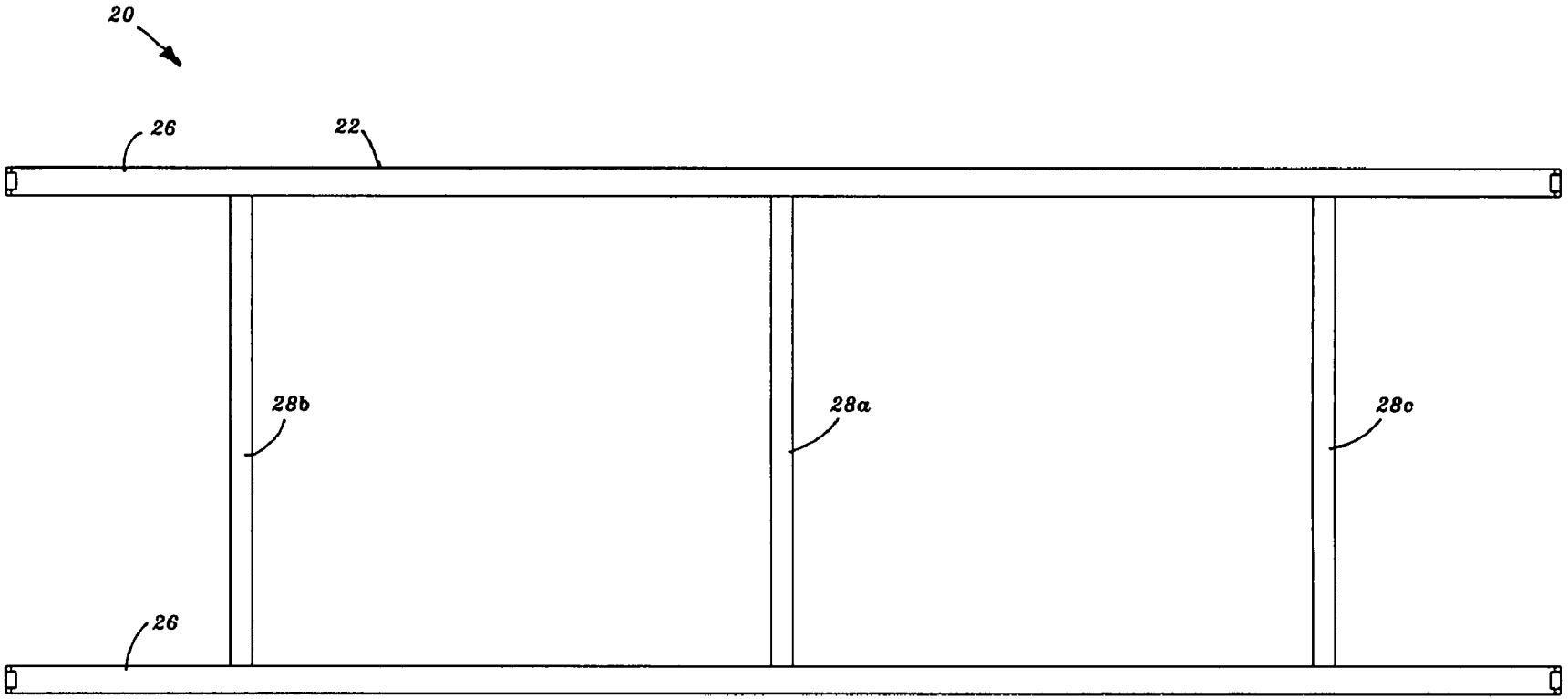
FIG. 2 is a top view of the base of the frame showing the structural members of the present invention.

As illustrated in FIG. 2, the frame 20 of one embodiment of the present invention 10 includes a base 22 and at least four perpenduicular supporting members 24 positioned at the corners of frame 20. Base 22 is a conventional rectangular structure having at least two parallel longitudinal members 26 and at least two parrallel cross members 28 oriented perpendicular to and disposed between the longitudinal members 26. The preferred embodiment of the present invention includes six supporting members 24, two longitudinal members 26, and three cross members 28, where cross member 28*a* is a mid-span cross member and cross members 28*b*, 28*c* are external members disposed on either side of cross member 28*a*. All members 24, 26, 28 are joined together by conventional means such as welds, screws or bolts.

Figure 3:
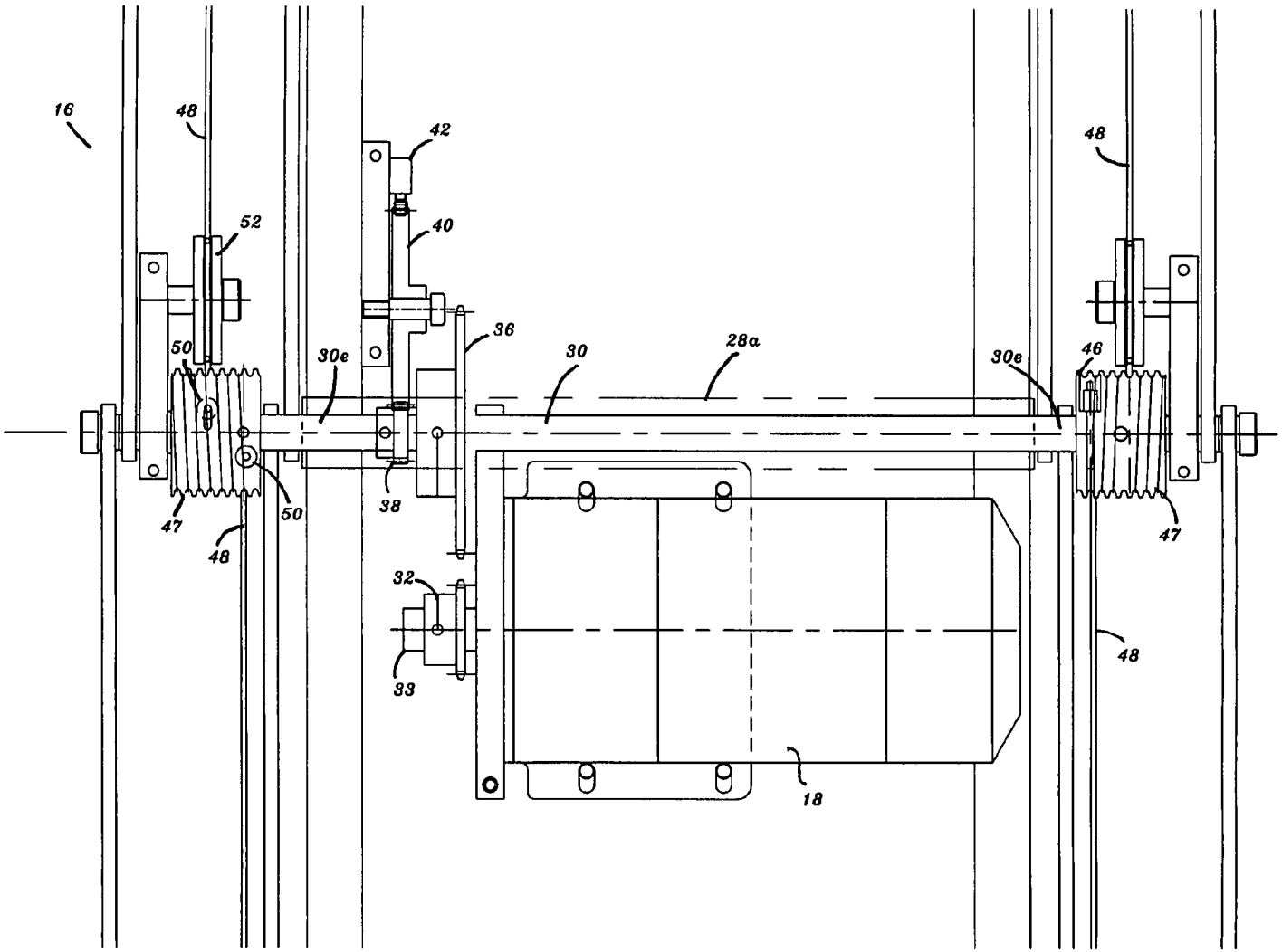
FIG. 3 is a top view of present invention illustrating the motor and drive system.
Figure 4:
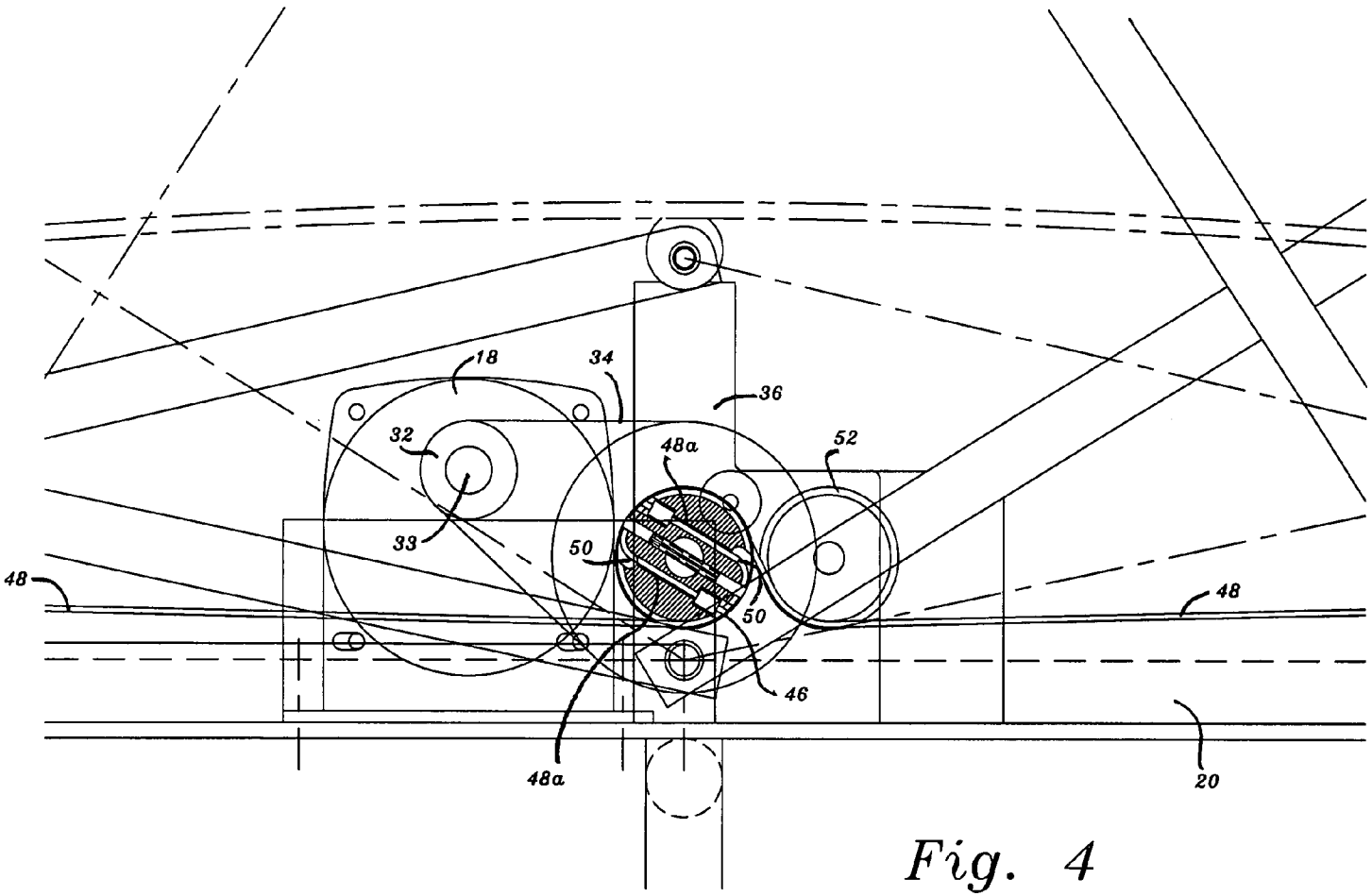
FIG. 4 is a pictorial view of the motor and drive system of present invention.
Figure 5:
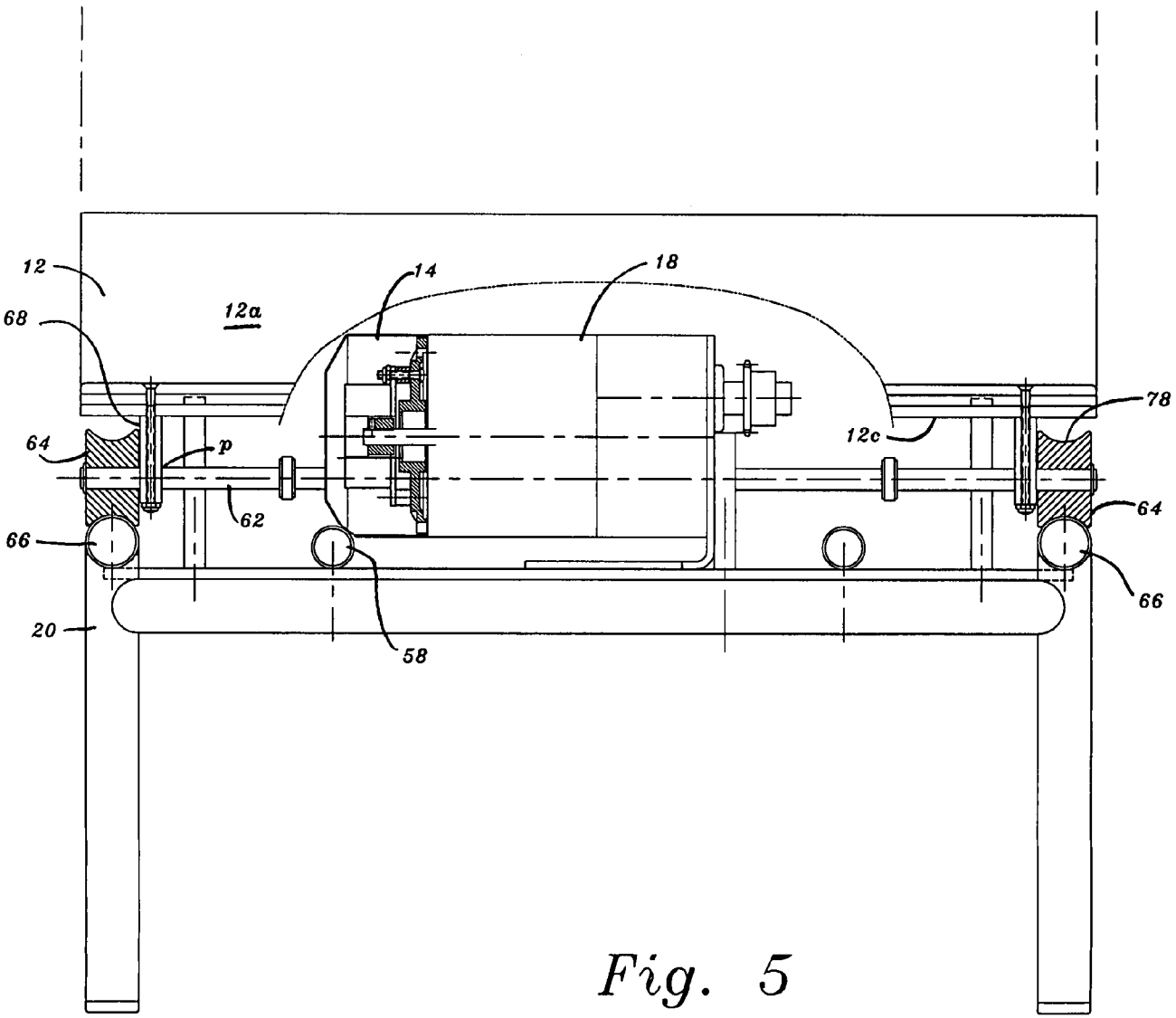
FIG. 5 is a partial section view of the motor illustrating the spring-actuated self-acting brake and a pictorial of the actuation system illustrating the guide rails.

Now turning to FIGS. 3 and 4, actuation system 16 is a cooperative combination of rollers, cables, links, pulleys, and connecting rods operatively connected to the motor 18 to change the curvature of sheet 12. Motor 18 is preferably a 115AC motor, for example Bodine model 0671, mounted to a mid-span cross member 28*a*. A small drive sprocket 32 is attached to a motor shaft 33 of motor 18. A chain 34 mechanically links small drive sprocket 32 to a large drive sprocket 36, which is attached to a main shaft 30. A small timing gear 38 attached to the main shaft 30 drives a large timing gear 40, which have cut-outs to trip limit switches 42. Limit switches 42 are electrically connected to the motor 18 to assure the apparatus 10 is not retracted below or extended above a predetemined sheet 12 arc radius (discussed below). As illustrated in FIG. 5, the motor 18 also includes a brake mechanism 44, such as spring actuated self-acting brake, to stop the present invention 10 from back driving the motor 18 (discussed below) when no electrical power is applied. An alternatively embodiment (not shown) uses of a self braking gear motor that eliminates brake mechanism 44. Additionally, mechanical stops 106 can be attached to frame 20, as illustrated in FIG. 6, to stop the sheet 12 from retracting below a predetermined radius, as illustrated in FIGS. 1, 6, and 7.

Now returning to FIG. 3, the actuation system 16 begins with a helix grooved pulley 46 attached to at least one end 30*e* of the main shaft 30. The preferred embodiment includes two helix grooved pulleys 46 with two cables 48 connected to each helix grooved pulley 46, as illustrated in FIG. 4. Each cable 48 has a first end 48*a* and a second end 48*b*. First end 48*a* of each cable 48 is inserted into opposing entry holes 50 of the helix grooved pulleys 46 and crimped to secure cables 48 to the helix grooved pulley 46. The cables 48 will be wound on to the helix grooved pulleys 46 at different vertical heights. This could cause problems with the smooth operation of the actuation system 16. To maintain, for example, both cables 48 in a substantially same horizontal orientation along the length of the frame 20, an idler pulley 52 is employed, as illustrate in FIG. 4. In the preferred embodiment, the two helix grooved pulleys 46 have opposing groove orientations 47 to compensate for main shaft 30 rotational direction. One helix grooved pulley 46 will wind one cable 48 in the clockwise direction and the other helix grooved pulley 46 will wind the other cable 48 in the counter-clockwise direction. Though two pulleys with a pair of cables 48 attached to each pulley 46 are illustrated, it is witin the contemplation of the present invention that the use of only one cable and one helix grooved pulley will achieve the objects of the invention.

Figure 6:
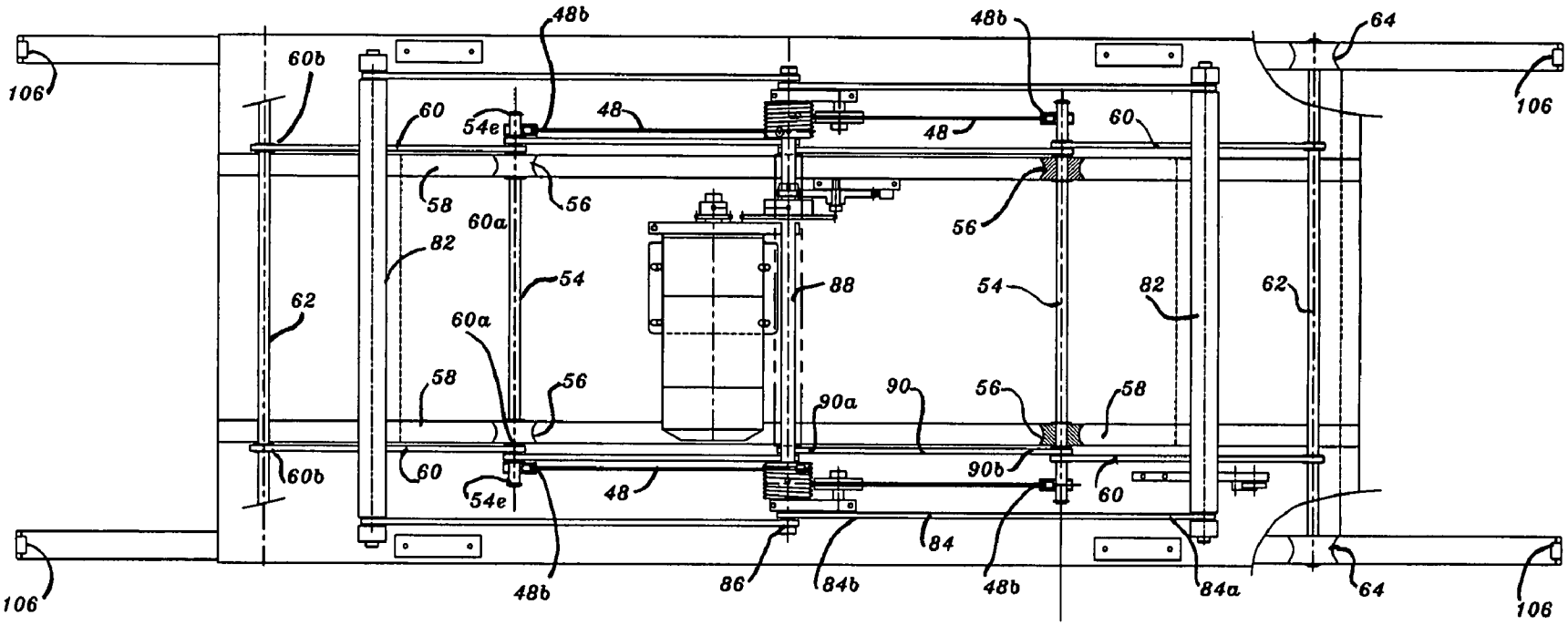
FIG. 6 is a top view of the present invention illustrating the actuation system mechanism and support structure.

As illustrated in FIG. 6, the second end 48*b* of cable 48 is attached to an end 54*e* of an inner connecting rod 54. Inner guide rollers 56 are rotatably connected to the inner connecting rod 54. Inner guide rollers 56 horizontally move along inner guide rails 58, which are fixedly attached to the frame 20. Main guide roller links 60 are pivotal connected at a first end 60*a* to the inner connecting rod 54 and at a second end 60*b* to the main connecting rod 62. Now returning to FIG. 5, main guide rollers 64 are rotatably connected to the main connecting rod 62. Main guide rollers 64 horizontally move along mail guide rails 66, which are fixedly attached to the frame 20. The main connecting rod 62 is pivotally attached at point P to the sheet 12 (details discussed below).

Figure 7:
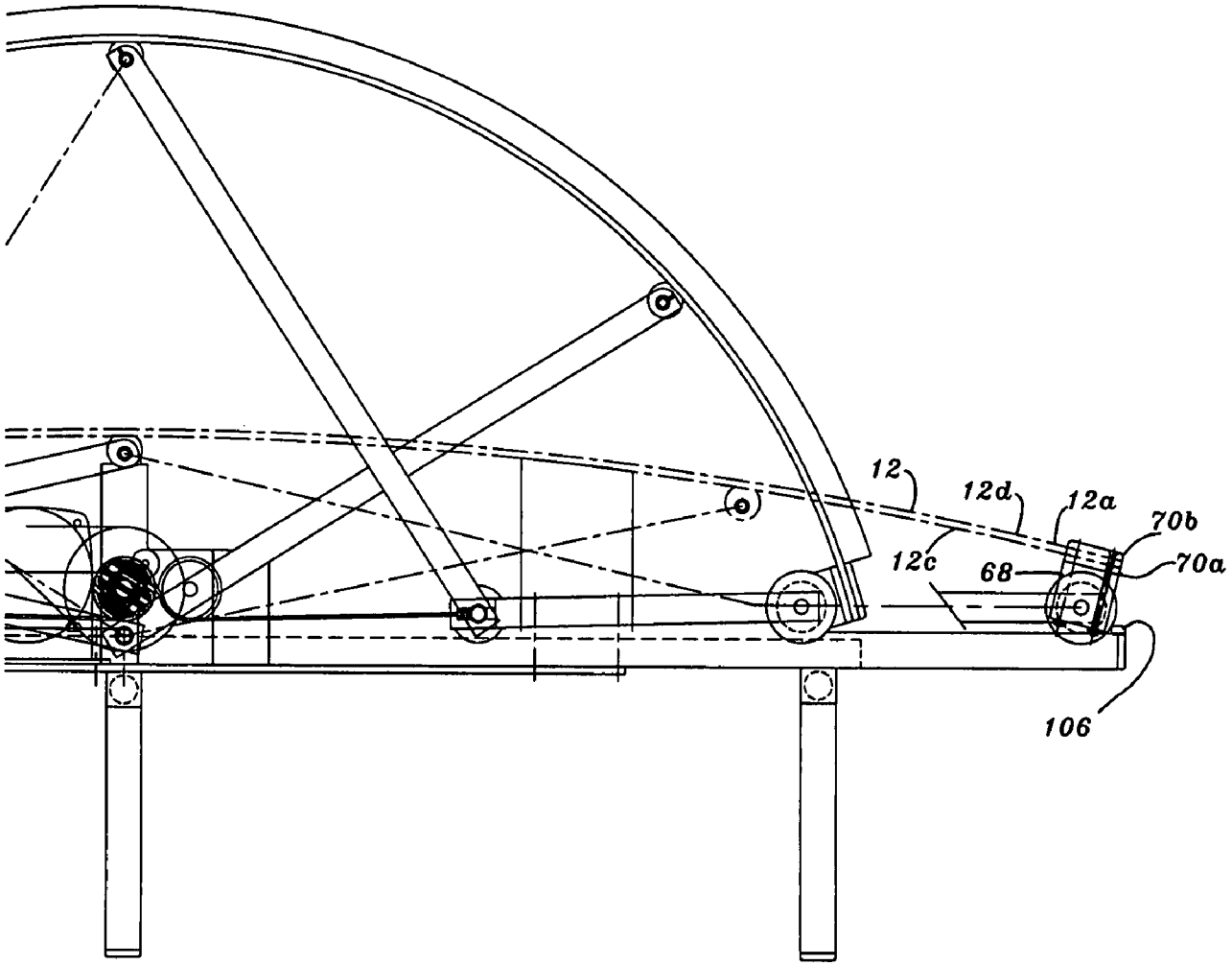
FIG. 7 is a side view of the present invention illustrating the sheet end attachment to the actuation system.
Figure 8:
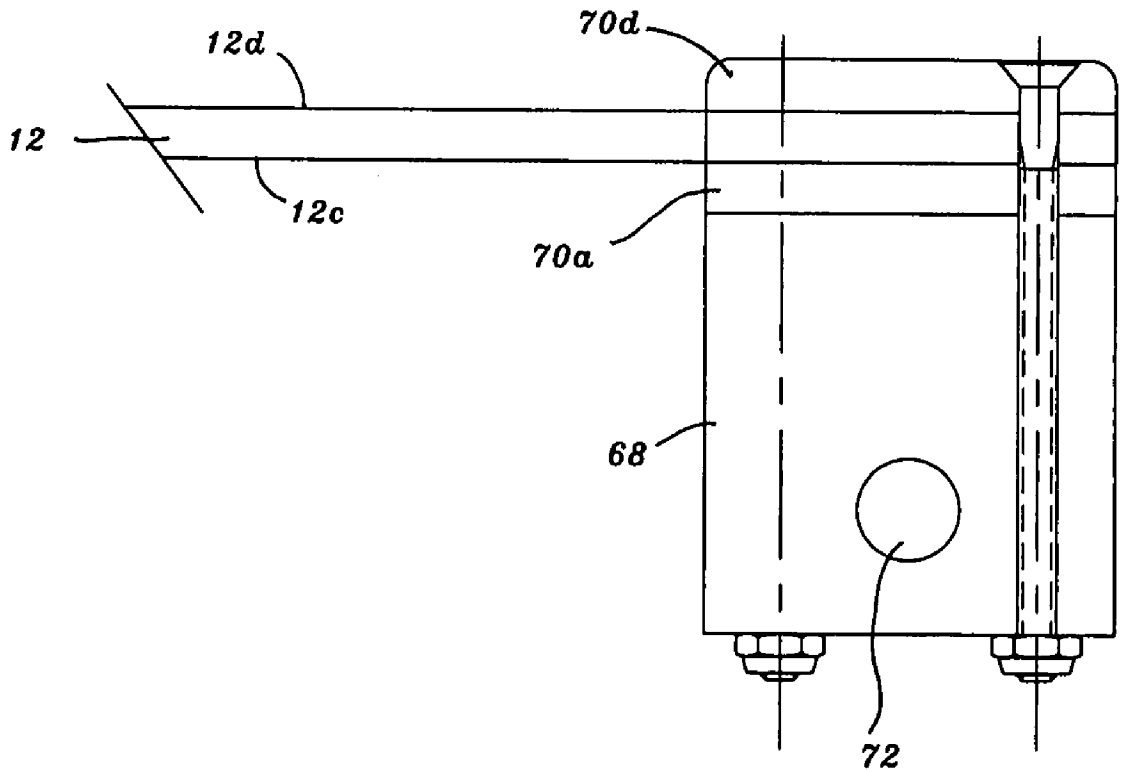
FIG. 8 is a pictorial of the main connecting rod supports of the preferred embodiment of the present invention.

As illustrated in FIGS. 5 and 7, two main connecting rod supports 68 are preferably fixedly attached to the bottom surface 12*c* of the sheet 12. The main connecting rod supports 68 can be bolted, as shown, to the sheet 12 at ends 12*a*, 12*b*. However any conventional attachment means, such as adhesive or doweled joint, is acceptable. The main connecting rod supports 68 are made of suitable material, such as plastic, graphite, metal or wood, to withstand operational stress modes. The sheet 12 of one embodiment of the present invention 10 is reinforced at ends 12*a*, 12*b* to withstand the bolt clamping loads and operational stress modes. The sheet ends 12*a*, 12*b* can be reinforced by two plates 70*a*, 70*b*, one each disposed on the bottom surface 12*c* and top surface 12*d*. However, only one plate may be required depending in the strength of the material used for sheet 12. The reinforcement plates 70*a*, 70*b* are conventionally attached to the sheet 12, but is preferrably attached by adhesive. As illustrated in FIG. 8, main connecting rod supports 68 include a connecting rod hole 72 with a diameter slightly larger than the main connecting rod 62 to allow free rotational movement of the main connecting rod 62 within the connecting rod hole 72.

Figure 9:
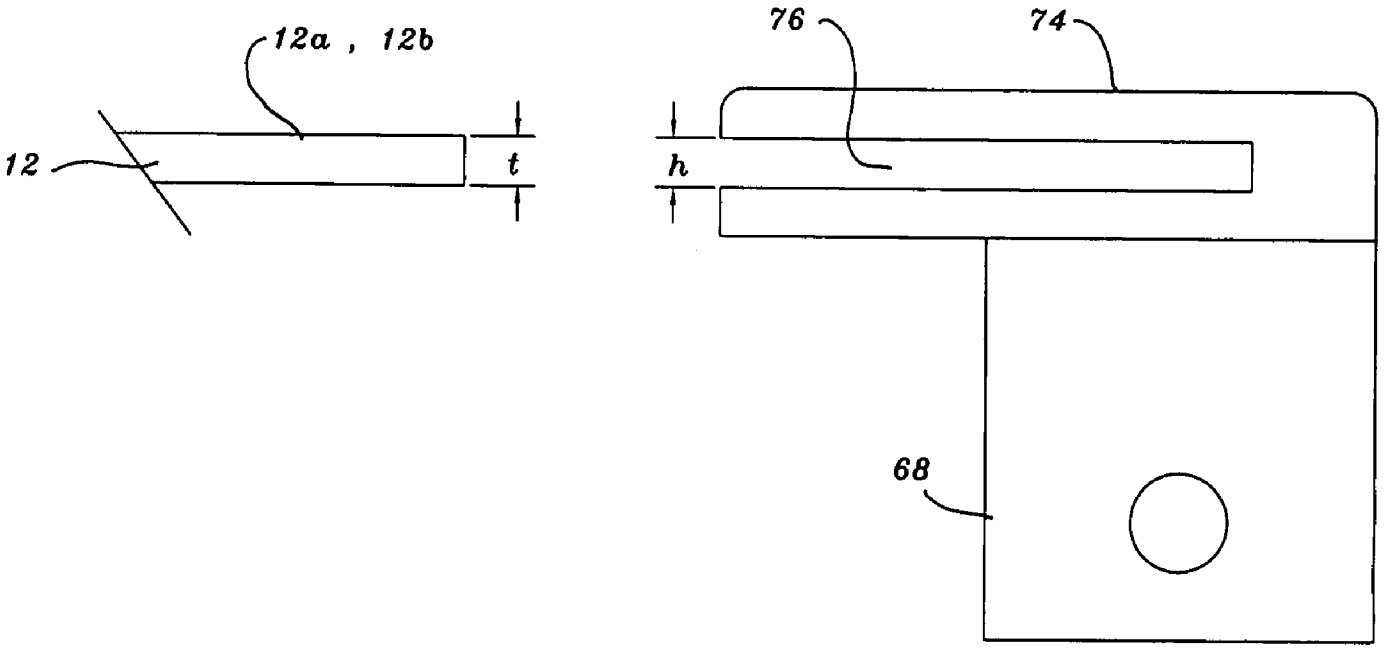
FIG. 9 is a pictorial of an alternative embodiment of the sheet end attachment to the actuation system of the present invention.

There are several alternative embodiments contemplated for attaching the main connecting rod supports 68 to the sheet 12. In one embodiment (not shown), the main connecting rod supports 68 are integral to the sheet ends 12*a*, 12*b*, and the sheet ends 12*a*, 12*b* may be reinforced to withstand operational stress modes. In another alternative embodiment illustrated in FIG. 9, an U-shaped attachment sleeve 74 is utilized having a cavity 76 to receive the sheet ends 12*a*, 12*b*. The U-shaped attachment sleeve 74 can be bolted to the sheet 12. Alternatively, the cavity 76 can be slightly narrower in height h than the thickness t of the sheet 12 such that an interference fit is formed between the sheet 12 and the U-shaped attachment sleeve 74, thereby holding the sheet within the U-shaped attachment sleeve 74 without additional attachment means, such as bolts, screws or adhesive. The U-shaped attachment sleeve 74 further includes integral or bolted on connecting rod supports 68.

Figure 10:
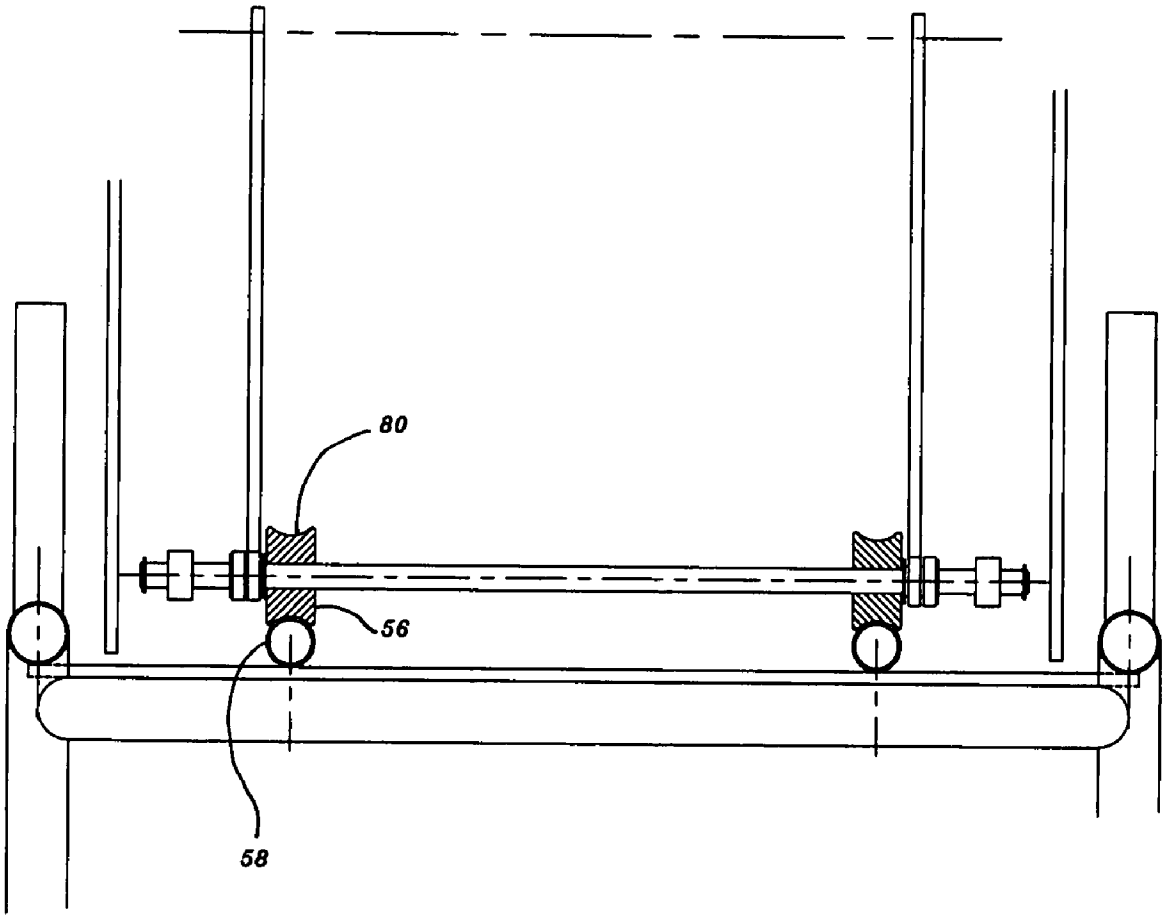
FIG. 10 is a frontal view of the present invention illustrating the inner guide rail and support structure.

As stated above, main guide rails 66 and inner guide rails 58 are attached to frame 20 to support the longitudinal translation of main guide rollers 64 and inner guide rollers 56, respectively, as the motor 18 draws the sheet 12 inward as the present invention 10 is extended and outward as the present invention 10 is retracted. To reduce potentional twisting of the sheet 12 during operation, the contact surface 78 of the main guide rollers 64 and the contact surface 80 of the inner guide rollers 56 are configured to be in contact with the main guide rails 66 and inner guide rails 58, respectively, as illustrated in FIGS. 5 and 10. Other types of rails and guides, such as a dovetail configuration, are also contemplated to a achieve the same result of constraining the corners of the sheet 12 from excessive vertical movement, which causes twisting and bending of the sheet 12.

For additional support of the sheet 12, one embodiment of the present invention 10 includes sheet reinforcement rods fixedly attached to the sheet 12 at predetermined locations. Returning to FIGS. 1 and 6, quarter sheet reinforcement rods 82 are positioned approximately at one-quarter distance from sheet ends 12*a*, 12*b* of sheet 12. Quarter sheet reinforcement rods 82 are pivotally connected to quarter sheet supporting links 84 at end 84*a*. Quarter sheet support links 84 are pivotally attached at opposing end 84*b* to frame 20 at pivot point 86. Mid sheet reinforcement rod 88 is pivotally attached to mid sheet supporting links 90 at end 90*a*. Mid sheet support links 90 are pivotally attached at opposing end 90*b* to inner connecting rod 54, which rotably supports inner guide rollers 56. Main guide roller link 60 connects the inner connecting rod 54 to the main connecting rod 62, which pivotally connects to main guide rollers 64. Inner guide rollers 56 move along inner guide rails 58, which are fixedly attached to the frame 20, during the extension and retraction operations.

As stated above, a preferred embodiment of the present invention 10 has a retraction and extension arc range from approximately 147 inch radius to 27 inch radius, respectively. The 147 inch radius retracted position assures a positive angle for ease of extension, however, any radius above 180 inch or flat is acceptable. The 27 inch radius extended position assures a safe and confrontable radius to maximize muscle stretching and spine compression, however radii smaller than 27 inch radius are also acceptable. As best seen in FIG. 1, the sheet 12, is caused by motor 18 to raise the midsection 12*c* of sheet 12 from a retracted position A (phantom lines) to an extended position B.

Figure 11:
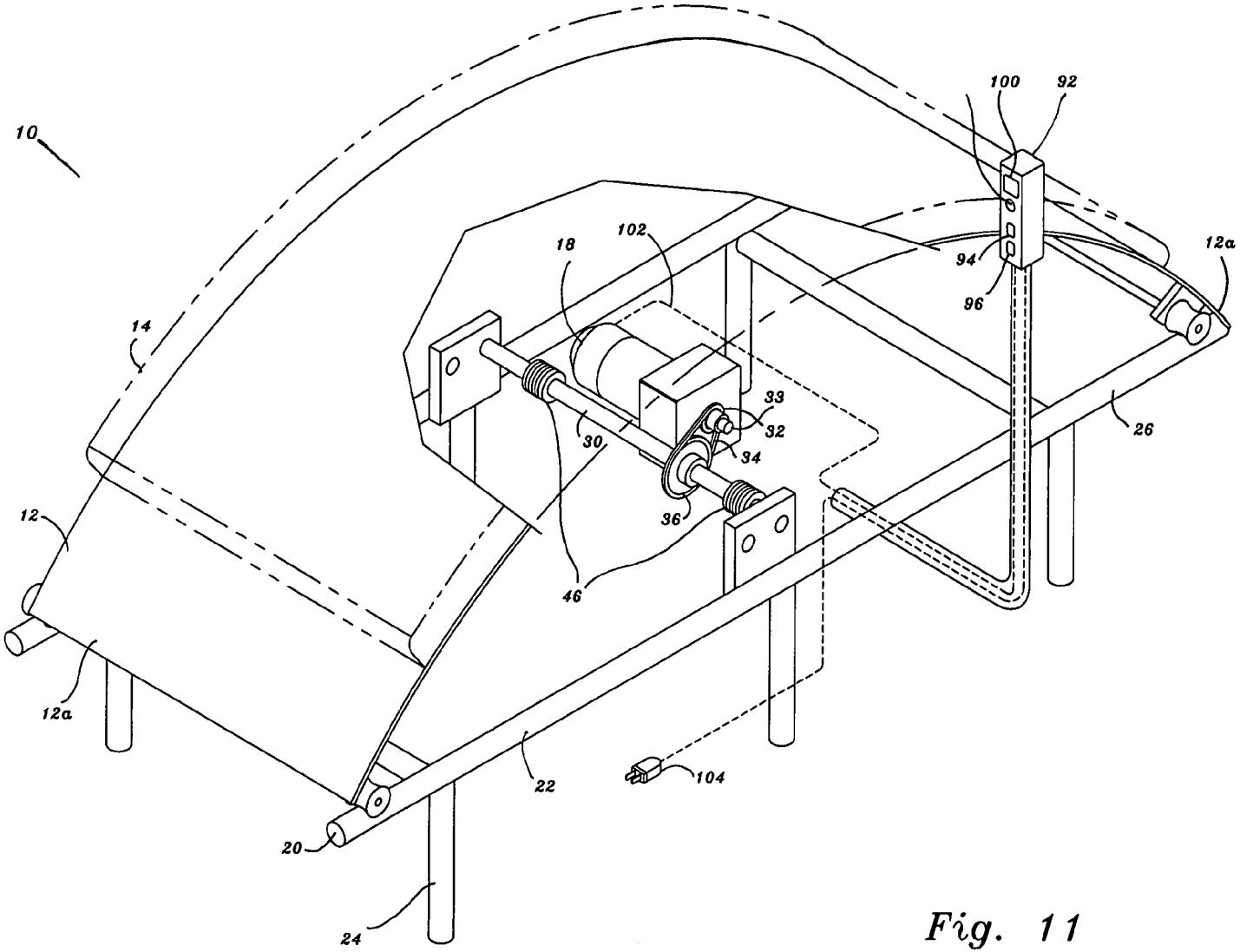
FIG. 11 is a isometric view of the control system of the present invention.

As illustrated in FIG. 11, the control box 92 is connected by control lead 102 to motor 18. The control box 92 includes an up button 94, down button 96, and a programable timer button 98, which can program one-cycle up to a desired time period, such as three minutes, to customize the maximum arc for each user. The control box 92 may include a display means 100 that electronically displays, for example, the measurement of a radius or time into the cycles. The display means 100 is a conventional device, such as digital, liquid-crystal or LED types. Power cord 104 connects the control box 92 to a suitable 110V or 220V electrical source (not shown).

The vinyl-covered cushioning material 14 may be a foam and/or inflatable pad (¼"–4" thickness) covering the surface of the sheet 12 for user comfort. The foam padding and/or inflatable bladders may be incorporated at strategic points on the sheet to increase or decrease the intensity of the stretching and/or decompression effect. Also the cushion material 14 may be further augmented by any of the following devices, whether individually or in combination, imparting heat, cold, vibration or mechanical massage.

In use of the present invention 10, control box 92 is used to change the arc of sheet 12. Pushing the up button 94 causes the midsection 12*c* of sheet 12 to rise. Midsection 12*c* will continue to rise until the down button 96 is pushed or until the highest position programmed is reached. Pushing the down button 96 causes the sheet 12 to lower. The sheet 12 will continue downwardly until the off button is pushed or until the lowest position programmed is reached or limit switches 42 are activated or mechanical stops 106 are contacted by the rollers 64.

One alternative embodiment includes one end of the sheet 12 being pivotally attached to the frame 20 but not capable of horizontal movement toward the opposing end of the sheet 12. The opposing end of the sheet 12 will be drawn toward the pivotal end until the desired arc is formed, which is twice the distance of the preferred embodiment.

One alternative embodiment includes a ball-screw drive mechanism in place of the pulley system 18.

One alternative embodiment implements the apparatus 10 within, underneath or on top of a user's mattress. This may provide muscle stretching and spine decompression to the user while lying in bed to increase relaxation before sleep or to reduce morning stiffness after sleeping. The user may also obtain the benefits of the invention while sleeping by programming the device to provide a sleep mode, which would cause it to operate at a reduced speed and degree of arcing.

Another alternative embodiment including a mechanized pivoting capability, which would create a vertical (standing) start and stop position for the user. The user would therefore be able to enjoy the benefits of the device without having to exert the considerable effort needed to raise and lower their body from a horizontal position. This would increase the comfort and safety of the user, especially those with soft tissue and/or spinal injury.

Another alternative embodiment mechanically draws down both ends of the sheet 12, or either end independently, onto a rigid and weight bearing 180 degree arc form underlying the sheet 12 and thereby creating a desired arc as the sheet 12 gradually conforms to the unyielding surface below it. This embodiment may be effective in hospital and/or rehabilitation facilities having users needing aid in transfer to the device. The table height elevation may reduce risk of injury both to the user and to the attendants assisting. Drawing the ends down as opposed to lifting the center up provides a measure of safety by preventing the user's body from raising any higher than table height while affording assistants the opportunity to aid the person on the sheet conveniently.

And yet a further alternative embodiment is an apparatus implemented for use within, or on top of, an automobile seat to provide muscle stretching and spine decompression while driving.

It will now be apparent to those skilled in the art that other embodiments, improvements, details, and uses can be made consistent with the letter and spirit of the foregoing disclosure and within the scope of this patent, which is limited only be the following claims, construed in accordance with the patent law, including the doctrine of equivalents.

What is claimed is:

1. A device for stretching the muscles and decompressing the spine of a user, comprising:

a flexible sheet, having two ends, engaging a horizontal surface, for supporting the user in a substantially horizontal position;

actuation means for bending said flexible sheet, wherein said actuation means comprises:

a motor, having a shaft;

at least a first and second pulley connected to said shaft; and at least a first and second cable, each having a first end and a second end, with the first end of the first cable attached to the first pulley and the second end of the first cable attached to said first end of said flexible sheet; and the first end of the second cable attached to the second pulley and the second end of the second cable attached to said second end of said flexible sheet.

2. The device as claimed in claim 1, further comprising at least one pivotal support having a first end and a second end, wherein said first end is pivotally connected to said flexible sheet, wherein said second end is pivotally connected to a support means that traverses in a substantially horizontal direction to increase or decrease the radius of said flexible sheet.

* * * * *